United States Patent [19]

Paxton

[11] Patent Number: 5,039,056

[45] Date of Patent: Aug. 13, 1991

[54] FLAGPOLE HOLDER

[76] Inventor: Joseph A. Paxton, 4144 W. Dunlap, Phoenix, Ariz. 85051

[21] Appl. No.: 467,996

[22] Filed: Jan. 22, 1990

[51] Int. Cl.[5] ..... H01Q 1/12

[52] U.S. Cl. ..... 248/539; 248/538

[58] Field of Search ..... 248/539, 338, 540, 534, 248/536, 537; 116/28 R, 173

[56] References Cited

U.S. PATENT DOCUMENTS

| | | | |
|---|---|---|---|
| 1,198,840 | 9/1916 | Hanck et al. | 116/173 X |
| 1,928,563 | 9/1933 | Hetzel | 248/539 |
| 2,208,358 | 7/1940 | Chandler | 248/539 X |
| 2,546,855 | 3/1951 | Frame | 248/539 X |
| 2,686,029 | 8/1954 | Raymond | 248/539 |
| 2,764,122 | 9/1956 | Irvin | 248/539 X |
| 3,438,651 | 4/1969 | Hertoghe et al. | 248/539 X |
| 3,493,203 | 2/1970 | Gualano | 248/539 |
| 4,114,160 | 9/1978 | Verini | 248/539 |
| 4,149,694 | 4/1979 | Verini | 248/539 |

*Primary Examiner*—Ramon O. Ramirez
*Attorney, Agent, or Firm*—Harry M. Weiss

[57] ABSTRACT

A flagpole holder for attaching a flagpole to a surface portion or axle of vehicle that allows the user to remove the flagpole without removing the apparatus from the vehicle. Various embodiments are disclosed to permit attachment of the flagpole holder to a bicycle axle and to various (vertical, horizontal and slanted) surface portions of a vehicle.

4 Claims, 1 Drawing Sheet

FLAGPOLE HOLDER

BACKGROUND OF THE INVENTION

1. Field of Invention

This invention relates generally to devices and methods therefor for attaching and flying a flag or pennant from a vehicle and, in particular, to an improved device and method therefor into which a flagpole can be inserted and secured and which also can be attached to the axle of a bicycle, motorcycle or the fender of a vehicle such as a car, skateboard or a child's wagon.

2. Description of the Prior Art

A number of devices for attaching a flagpole to a vehicle are commercially available. One such prior device, used to attach a flagpole to a bicycle, comprises a flagpole having a vee-shaped prong at one end. The vee-shaped prong is slid onto a bicycle axle and secured there by a plurality of nuts. Another prior device comprises a flagpole having a hole at one end. The hole slides onto the bicycle axle and is secured by a nut. In each of these prior devices, the attachment mechanism is integral with the flagpole and must be removed when the flagpole is removed. For vehicles such as a car, the only means of attaching a flag or pennant is either to drill a hole through the fender or to tie the flag or pennant onto the radio antenna. For a child's wagon or skateboard, drilling a hole through the vehicle is the only available means for attaching a flag.

Therefore, there is a need for a simple, inexpensive device for attaching a flagpole to a vehicle that allows the user to remove the flagpole without removing the attachment device.

SUMMARY OF THE INVENTION

An objective of the present invention is to provide an improved flagpole holder device and method therefor for attaching a flagpole to a vehicle from which the flag can be removed without detaching the device.

Another objective of the present invention is to provide an improved flagpole holder device that can be attached to the axle of a bicycle or motorcycle.

Yet still another objective of the present invention is to provide an improved flagpole holder device that can be attached to any vertical surface like the side of a child's wagon.

Yet still another objective of the present invention is to provide an improved flagpole holder device that can be attached to any horizontal surface like the edge of a skateboard.

Yet still another objective of the present invention is to provide an improved flagpole holder that can be attached to a slanted surface like the fender of an automobile.

These and other objectives, features and advantages of the present invention, as well as details of the preferred embodiment thereof, will be more fully understood from the following description and drawing.

DESCRIPTION OF THE PREFERRED EMBODIMENT

Figure 1:
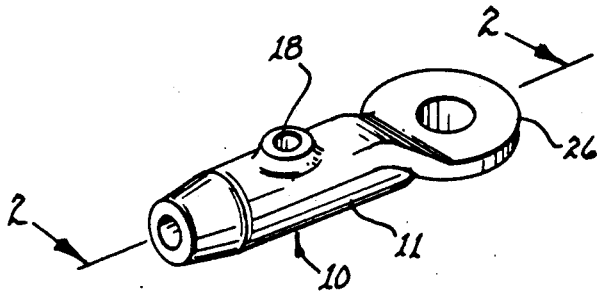
FIG. 1 is a perspective view of the flagpole holder device of the present invention.
Figure 2:
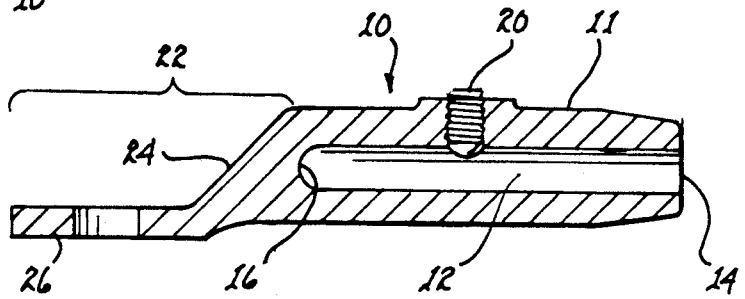
FIG. 2 a cross-sectional view taken along line 2—2 of FIG. 1.

Referring to the drawings, FIGS. 1–2 show the flagpole holder of the present invention generally designated by number 10. In this embodiment, the flagpole holder 10 is designed to be attached to an axle of a vehicle. The holder 10 has a tube 11 having a bore 12 extending therethrough from an entrance end 14 to a closed end 16. The diameter of the bore 12 is sized to closely receive a flagpole. At a point about half the length of the tube 11 is a threaded hole 18 (see FIG. 1) extending from the external surface of the tube 11 to the bore 12. A threaded locking member 20 (see FIG. 2) can be screwed into the hole !8 so as to forcibly contact and lock an end portion of a flagpole (not shown) in the bore 12 of the tube 11, after the flagpole has been inserted. Integral with the tube 11 and positioned below the tube 11 is a base portion 22. The base portion 22 has a slanted section 24 so that the base portion 22 will not interfere with a frame of a bicycle when the holder 10 is mounted on the bicycle's axle. Below the slanted section 24 is a ring member 26 having a center aperture sized to fit around the axle of a bicycle or other type of wheeled vehicle such as a motorcycle.

Figure 3:
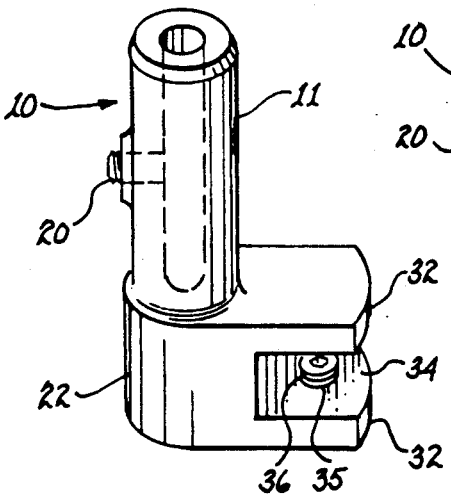
FIG. 3 is a perspective view of an alternative embodiment of the present invention.
Figure 4:
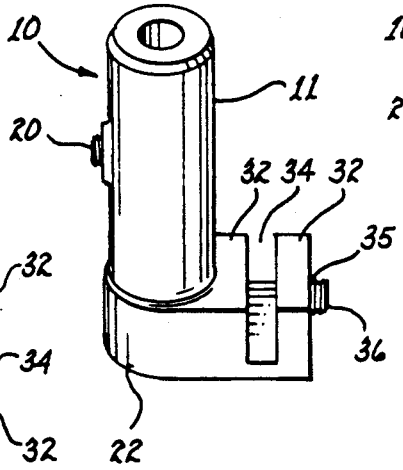
FIG. 4 is a perspective view of another alternative embodiment of the present invention.
Figure 5:
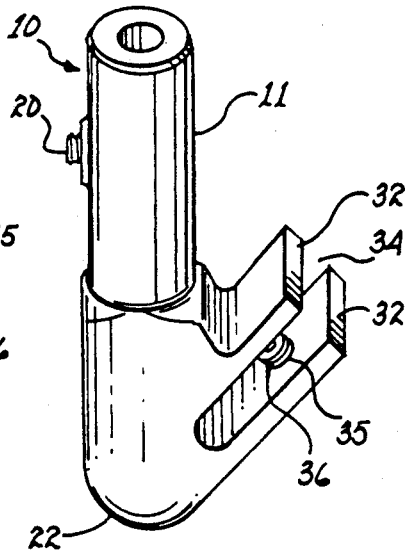
FIG. 5 is a perspective view of yet another alternative embodiment of the present invention.

FIGS. 3–5 illustrate a number of alternative embodiments of the flagpole holder of the present invention. In each of these alternate embodiments the tube 11 is the same as described above and only the base portions 22 differ from embodiment to embodiment. In FIG. 3, the base portion 22 has a substantially block shape with two prongs 32 perpendicular to the tube 11. Between the two prongs 32 is a channel 34 into which a horizontal edge portion of a vehicle can be inserted. One of these prongs 32 has a threaded hole 35 into which a locking member 36 (like the threaded locking member 20 of FIG. 2) can be inserted thereby providing a secure, positive grip on the inserted horizontal edge portion of the vehicle. This arrangement will secure a flagpole to the vehicle. In FIG. 4 the prongs 32 are parallel to the tube 11 for receiving a vertical surface edge portion of a vehicle. One of the prongs 32 also has a threaded hole 35 into which a locking member 36 can be inserted. Lastly, in FIG. 5 the prongs 32 are arranged at an angle from the tube 11 for receiving a slanted surface edge portion of a vehicle and the base portion 22 is also configured to support the two angled prongs 32. One of these prongs 32 has a threaded hole 35 for receiving a locking member 36.

The use of the holder 10 in the embodiment of FIG. 1 is simple and easy. A flagpole is first inserted all the way into the tube 11 so that the end of the flagpole abuts the closed end 16 of the tube 11. The locking member 20 is inserted into the hole I8 until the flagpole is secured. The ring member 26 is preferably slid onto an axle of a bicycle between the wheel guard and the frame.

While the invention has been particularly shown and described with reference to a preferred embodiment thereof, it will be understood by those skilled in the art that changes in form and detail may be made therein without departing form the spirit and the scope of the invention.

I claim:

1. A flagpole holder for attaching a flagpole to a vehicle, comprising:

a tube having bore means extending partly therethrough from an open entrance end to a closed end for receiving said flagpole;

means coupled to said bore means for selectively gripping or releasing said flagpole; and a base portion, on which said tube is mounted, having means for coupling said flagpole holder to said vehicle;

wherein said means for coupling said flagpole holder to said vehicle comprises a ring member through which an axle of said vehicle can be inserted.

2. A flagpole holder for attaching a flagpole to a vehicle, comprising:

a tube having bore means extending partly therethrough from an open entrance end to a closed end for receiving said flagpole;

means coupled to said bore means for selectively gripping or releasing said flagpole; and a base portion, on which said tube is mounted, having means for coupling said flagpole holder to said vehicle;

wherein said means for coupling said flagpole holder to said vehicle comprises at least two prongs mounted perpendicular to said tube and separated by a channel for receiving a horizontal surface edge portion of said vehicle, at least one of said two prongs having a hole therethrough, and locking means coupled to said hole in said one of said two prongs including for inserting a locking member for securing said flagpole holder on said surface edge portion.

3. A flagpole holder for attaching a flagpole to a vehicle, comprising:

a tube having bore means extending partly therethrough from an open entrance end to a close end for receiving said flagpole;

means coupled to said bore means for selectively gripping or releasing said flagpole; and a base portion, on which said tube is mounted, having means for coupling said flagpole holder to said vehicle;

wherein said means for coupling said flagpole holder to said vehicle comprises at least two prongs mounted parallel to said tube and separated by a channel for receiving a vertical surface edge portion of said vehicle, at least one of said two prongs having a hole therethrough and locking means coupled to said hole in said one of said two prongs including a locking member for securing said flagpole holder on said surface edge portion.

4. A flagpole holder for attaching a flagpole to a vehicle, comprising:

a tube having bore means extending partly therethrough from an open entrance end to a closed end for receiving said flagpole;

means coupled to said bore means for selectively gripping or releasing said flagpole; and a base portion, on which said tube is mounted, having means for coupling said flagpole holder to said vehicle;

wherein said means for coupling said flagpole holder to said vehicle comprises at least two prongs mounted at an angle with respect to the center axis of said tube and separated by a channel for receiving an angled surface edge portion of said vehicle, at least one of said two prongs having a hole therethrough, and locking means coupled to said hole in said one of said two prongs including a locking member for securing said flagpole holder on said surface edge portion.

* * * * *